US006807944B2

(12) United States Patent
Mizuno et al.

(10) Patent No.: US 6,807,944 B2
(45) Date of Patent: Oct. 26, 2004

(54) METHOD AND APPARATUS FOR ATTENUATING PRESSURE PULSATION IN OPPOSED ENGINES

(75) Inventors: Kazuteru Mizuno, Numazu (JP); Hikari Tsuchiya, Gotenba (JP); Tetsuo Ogata, Shizuoka (JP); Yoshiyuki Serizawa, Mishima (JP)

(73) Assignee: Usui Kokusai Sangyo Kaisha, Ltd., Shizuoka-ken (JP)

( * ) Notice: Subject to any disclaimer, the term of this patent is extended or adjusted under 35 U.S.C. 154(b) by 0 days.

(21) Appl. No.: 10/681,999

(22) Filed: Oct. 8, 2003

(65) Prior Publication Data

US 2004/0069277 A1 Apr. 15, 2004

(30) Foreign Application Priority Data

Oct. 9, 2002 (JP) ..... 2002-296576

(51) Int. Cl.[7] ..... F02M 55/02

(52) U.S. Cl. ..... 123/467; 123/456; 123/468

(58) Field of Search ..... 123/456, 468, 123/469, 467; 138/26–30

(56) References Cited

U.S. PATENT DOCUMENTS

| | | | | | |
|---|---|---|---|---|---|
| 3,507,263 | A | * | 4/1970 | Long | 123/455 |
| 4,660,524 | A | * | 4/1987 | Bertsch et al. | 123/468 |
| 4,729,360 | A | * | 3/1988 | Fehrenbach et al. | 123/447 |
| 5,056,489 | A | * | 10/1991 | Lorraine | 123/468 |
| 5,197,436 | A | * | 3/1993 | Ozawa | 123/456 |
| 5,311,850 | A | * | 5/1994 | Martin | 123/456 |
| 5,373,824 | A | * | 12/1994 | Peters et al. | 123/527 |
| 5,884,607 | A | * | 3/1999 | Schiller et al. | 123/467 |
| 6,371,083 | B1 | * | 4/2002 | Rossi et al. | 123/456 |
| 6,418,910 | B1 | * | 7/2002 | Nally et al. | 123/456 |
| 6,640,783 | B2 | * | 11/2003 | Braun et al. | 123/467 |
| 6,725,839 | B2 | * | 4/2004 | Zdroik et al. | 123/456 |
| 2002/0043249 | A1 | * | 4/2002 | Lee et al. | 123/456 |

FOREIGN PATENT DOCUMENTS

| | | | |
|---|---|---|---|
| EP | 1 188 919 | * 3/2002 | F02M/59/36 |
| JP | 60-240867 | 11/1985 | |
| JP | 11-2164 | 1/1999 | |
| JP | 11-37380 | 2/1999 | |
| JP | 2000-320422 | 11/2000 | |
| JP | 2000-329030 | 11/2000 | |
| JP | 2000-329031 | 11/2000 | |

* cited by examiner

*Primary Examiner*—Thomas Moulis
(74) *Attorney, Agent, or Firm*—Jordan and Hamburg LLP

(57) ABSTRACT

A returnless type fuel delivery pipe is provided for each cylinder bank of an opposed type engine. A connecting pipe is connected to this pair of fuel delivery pipes, a supply pipe is connected to this connecting pipe, thus coupling the fuel delivery pipes with the fuel tank. The fuel delivery pipes are made to be capable of absorbing and reducing pressure pulsation through elastic deformation of the external walls thereof, and the supply pipe is connected to an intermediate section of the length of the connecting pipe. Pressure pulsations with opposite phases caused by fuel injection of the fuel delivery pipes interfere with and attenuate each other in the supply pipe at or near intersection thereof with the intermediate section of the connecting pipe.

2 Claims, 9 Drawing Sheets

METHOD AND APPARATUS FOR ATTENUATING PRESSURE PULSATION IN OPPOSED ENGINES

BACKGROUND OF THE INVENTION

1. Field of the Invention

The present invention relates to a method and apparatus for attenuating pressure pulsation in V-type engines, horizontally opposed engines, and other opposed engines, thereby preventing the degradation of fuel supply characteristics arising from pressure pulsation and the occurrence of pressure pulsation noise in opposed engines.

2. Background Art

Conventionally, fuel delivery pipes have been known that have a plurality of injection nozzles for feeding fuels such as gasoline to a plurality of engine cylinders. With such fuel delivery pipes, fuel from a fuel tank is sprayed in order by a plurality of injection nozzles into a plurality of engine intake pipes or cylinders; the fuel mixes with air and this mixture burns, causing engine output.

As described above, the function of such a fuel delivery pipe is to spray from injection nozzles fuel fed from the fuel tank via a supply pipe into engine intake pipes or cylinders. With a return-type fuel delivery pipe, when an excess of fuel has been fed into the fuel delivery pipe, a loop returns the excess fuel to the fuel tank using a pressure regulator. By contrast, a returnless-type fuel delivery pipe does not have such a loop for returning fed fuel to the fuel tank.

A fuel delivery pipe that returns excess fuel to the fuel tank has the advantage that pressure pulsation arising from fuel injection does not easily occur, as the amount of fuel in the fuel delivery pipe can be kept constant. However, fuel delivery pipes are disposed close to engine cylinders, which are hot, and fuel fed to a fuel delivery pipe also becomes heated; when heated excess fuel is returned to the fuel tank, the temperature of the gasoline in the fuel tank rises. This rise in temperature causes gasoline to vaporize, and this has harmful effects on the environment and thus is not desirable. For this reason, returnless-type fuel delivery pipes have been proposed that do not return excess fuel to the fuel tank.

Because such a returnless fuel delivery pipe does not have piping for returning excess fuel to the fuel tank, when fuel has been injected from injection nozzles into intake pipes or cylinders, there is large oscillation in pressure and large pressure waves arise, so that the occurrence of pressure pulsation is greater than with a return-type fuel delivery pipe.

The present invention uses a returnless fuel delivery pipe, in which pressure pulsation can easily occur. In the conventional art, when pressure inside a fuel delivery pipe is reduced by the injection of fuel from injection nozzles into intake pipes or cylinders, this sudden drop in pressure and the pressure waves arising from the stopping of fuel injection cause pressure pulsations within the fuel delivery pipe. These pressure pulsations are propagated from the fuel delivery pipe and a connecting pipe connected to the fuel delivery pipe to the fuel tank via a supply pipe, and then are reversed and sent back by a pressure adjustment valve within the fuel tank, propagating to the fuel delivery pipe via the supply pipe and connecting pipe. A fuel delivery pipe has a plurality of injection nozzles; these injections nozzles sequentially inject fuel, causing pressure pulsation.

As a result, these pressure pulsations cause pressure within the fuel delivery pipe to drop suddenly, leading to the phenomenon of less fuel being injected into the intake pipes or cylinders. This causes the mix ratio of fuel gas and air to be different from specifications, leading to adverse effects on exhaust gas and the engine not outputting the specified power. Pressure pulsation also causes mechanical vibrations in a supply pipe connected to a fuel tank, and these vibrations are transmitted as noise to the passenger compartment of a vehicle by clips holding the supply pipe to below the floor, and such noise is annoying for a driver and passengers.

Conventionally, the following method has been used to prevent the various above-described drawbacks arising from pressure pulsation and limit the ill effects caused by pressure pulsation. A pulsation damper containing a rubber diaphragm is disposed in a returnless fuel delivery pipe lacking pressure pulsation absorption function in its outer walls; pressure pulsation energy is absorbed by this pulsation damper, and a supply pipe disposed below the floor from the fuel delivery pipe to the fuel tank is secured to below the floor by vibration-absorbing clips (not shown in the drawings), thereby absorbing vibration arising in the fuel delivery pipes or in the supply pipe extending to the fuel tank. Methods such as this are relatively effective, and have the advantageous effect of limiting ill effects caused by pressure pulsation.

However, pulsation dampers and vibration-absorbing clips are expensive, and use thereof leads to an increase in number of parts and in cost; they also give rise to a new problem of securing space in which they can be disposed. For this reason, inventions have been proposed that have a pulsation-absorption function, capable of absorbing pressure pulsation in a fuel delivery pipe without the use of such pulsation dampers or vibration-absorbing clips.

Inventions described in Japanese Laid-open patents JP, 2000-329030, A, JP, 2000-320422, A, JP, 2000-329031, A, JP, 11-37380, A, JP, 11-2164, A, and JP, 60-240867, A are known as fuel delivery pipes having such a pressure pulsation-absorption function. These fuel delivery pipes having pressure pulsation-absorption function have the effect of absorbing and attenuating pressure pulsation arising from fuel injection and preventing a variety of ill effects arising from the occurrence of pressure pulsation.

When these fuel delivery pipes are used in an inline engine, except for a few cases, these advantageous effects are easily realized; however, when used in a V-type engine, horizontally opposed engine or other opposed engine, in which banks of a plurality of cylinders are disposed in parallel, a fuel delivery pipe is provided for each of these banks of a plurality of cylinders, this pair of fuel delivery pipes is connected by a connecting pipe, and a supply pipe connects a fuel tank to a part of this connecting pipe, or directly to one of the fuel delivery pipes, then such a fuel delivery pipe is not necessarily effective in mitigating the various above-described ill effects.

Specifically, as shown in FIGS. 8 and 9, a pair of fuel delivery pipes (1), (2) are connected in series by a connecting pipe (3) to a pair of cylinder banks of a horizontally opposed engine. These fuel delivery pipes (1), (2) do not themselves have a pressure pulsation-absorption function; however, fuel delivery pipes are known that, as shown in FIG. 8, have an aforementioned pulsation damper (4) attached thereto, or that, as shown in FIG. 9, have a pressure pulsation-absorption function in the outer walls thereof. These pairs of fuel delivery pipes (1), (2) are connected in series with a connecting pipe (3).

With a pair of such returnless fuel delivery pipes (1), (2) connected from the connecting pipe (3) to the fuel tank via a supply pipe (5), when fuel is injected from injection nozzles (6) of one or the other of the fuel delivery pipes (1), (2), pressure drops within one or the other fuel delivery pipes (1), (2) and a pressure wave is generated. When the pair of fuel delivery pipes (1), (2) is connected in series with the connecting pipe (3), the pressure pulsation caused by this pressure wave is transmitted without attenuation, and in the pulsation resonance period, a large pressure pulsation wave is propagated from the fuel delivery pipes (1), (2) to the supply pipe (5), which includes piping in the floor. This pressure pulsation becomes a large pulsation in the supply pipe (5), connecting pipe (3), and the pair of fuel delivery pipes (1), (2). As a result, fuel injection is affected as described above and the proper mix ratio of fuel and air is not achieved, so that there are unwanted effects in terms of exhaust emissions as well as insufficient engine output; in addition, noise enters the passenger compartment of the vehicle through the supply pipe (5).

SUMMARY OF THE INVENTION

It is an object of the present invention to solve the above-described problems. Without employing an involved method including the use of an expensive pulsation damper (4) containing a rubber diaphragm or the securing of a supply pipe (5) disposed under the floor, from the fuel delivery pipes (1), (2) to the fuel tank, to the underside of the floor using vibration-absorbing clips, the present invention employs a simple, inexpensive method to absorb pressure pulsation arising in the fuel delivery pipes (1), (2) and limit the ill effects arising from pressure pulsation. More specifically, pressure pulsations with opposite phases arising from the fuel injection performed alternatingly between the cylinder banks by the injection nozzles (6) of the pair of fuel delivery pipes (1), (2) are propagated to the connecting pipe (3) and are caused to interfere with and attenuate each other in the supply pipe (5) at or near its intersection with an intermediate section of the connecting pipe (3).

In order to solve the problems described above, a first aspect of the present invention is a method wherein, in an arrangement wherein a returnless type fuel delivery pipe comprising a plurality of injection nozzles but not comprising a loop for returning fuel to the fuel tank is provided for each of a pair of banks comprising a plurality of cylinders of an opposed engine having such banks disposed in a horizontally opposed or V-shaped manner, a connecting pipe is connected to this pair of fuel delivery pipes, and this connecting pipe is connected to a supply pipe and thus coupled to a fuel tank: such fuel delivery pipes are made to be capable of absorbing and reducing pressure pulsation arising at time of fuel injection by injection nozzles by means of elastic deformation of the outer walls thereof, and pressure pulsations with opposite phases arising from the fuel injection performed alternatingly between the cylinder banks by the injection nozzles of the fuel delivery pipes are propagated to the connecting pipe, and are caused to interfere with and attenuate each other at a connecting part of the supply pipe connected to an intermediate section of the connecting pipe.

In addition, in order to solve the problems described above, a second aspect of the present invention is an apparatus that is a returnless type comprising a plurality of injection nozzles but not comprising a loop for returning fuel to the fuel tank, and is capable of absorbing and reducing pressure pulsation arising at time of fuel injection by injection nozzles, comprising: fuel delivery pipes provided for each bank of an opposed engine, such banks comprising a plurality of cylinders and being disposed opposed horizontally or in a V-shape, a connecting pipe coupling these fuel delivery pipes, and a supply pipe that connects and communicates with an intermediate portion along the length of this connecting pipe and is connected with a fuel tank, wherein: pressure pulsations with opposite phases arising from the fuel injection performed alternatingly between the cylinder banks by the injection nozzles of the fuel delivery pipes are propagated to the connecting pipe, and are caused to interfere with and attenuate each other in the supply pipe at or near its intersection with an intermediate portion of the connecting pipe.

Because the present invention is configured as described above, connecting the pair of fuel delivery pipes (1), (2) with the connecting pipe (3) and connecting the supply pipe (5) to an intermediate section of the length of this connecting pipe (3) enables reduction of pressure pulsation within the supply pipe (5). Generally, in an opposed engine in which banks comprising a plurality of cylinders are disposed in horizontal opposition or in a V-shape, fuel is injected alternatingly between the pair of opposed banks. As a result, the pair of opposing fuel delivery pipes (1), (2) generate pressure pulsations with phases that are the opposite of each other. These pressure pulsations with opposite phases are temporarily absorbed and reduced by the fuel delivery pipes (1), (2) which are capable of absorbing and reducing pressure pulsation by means of elastic deformation of the outer walls thereof. These temporarily reduced and absorbed pressure pulsations are propagated to the connecting pipe (3) which feeds fuel to the fuel delivery pipes (1), (2), and interfere with and attenuate each other in the supply pipe (5) that is coupled to the fuel tank, at or near the intersection of the supply pipe (5) with the connecting pipe (3), such intersection being at an intermediate section of the length of the connecting pipe (3). As a result, there is a significant reduction in the pressure pulsation transmitted within the supply pipe (5), including piping under the floor.

DETAILED DESCRIPTION OF THE INVENTION

Figure 1:
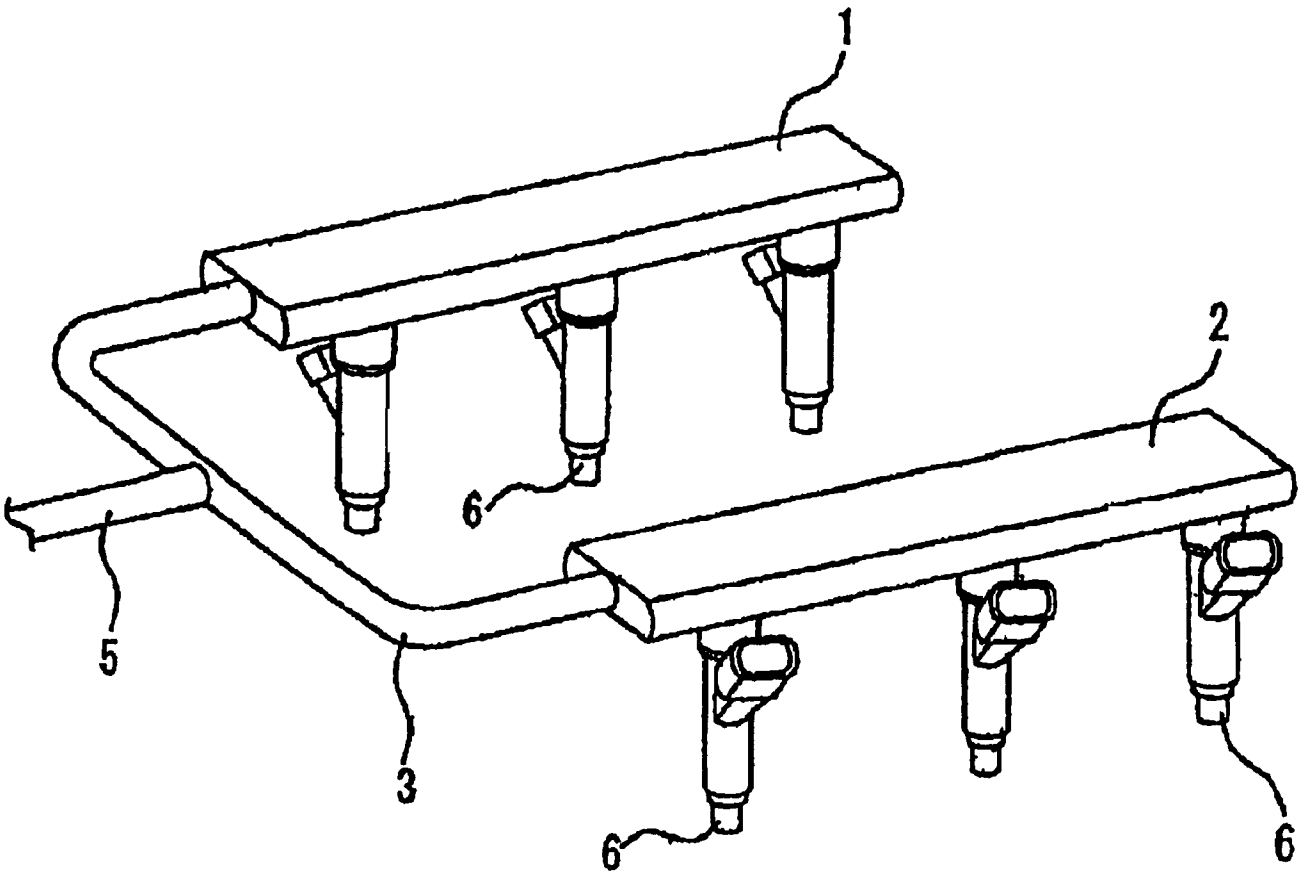
FIG. 1 is a perspective view showing the positional relationship of a pair of fuel delivery pipes, connecting pipe and supply pipe in a first embodiment of the present invention.
Figure 2:
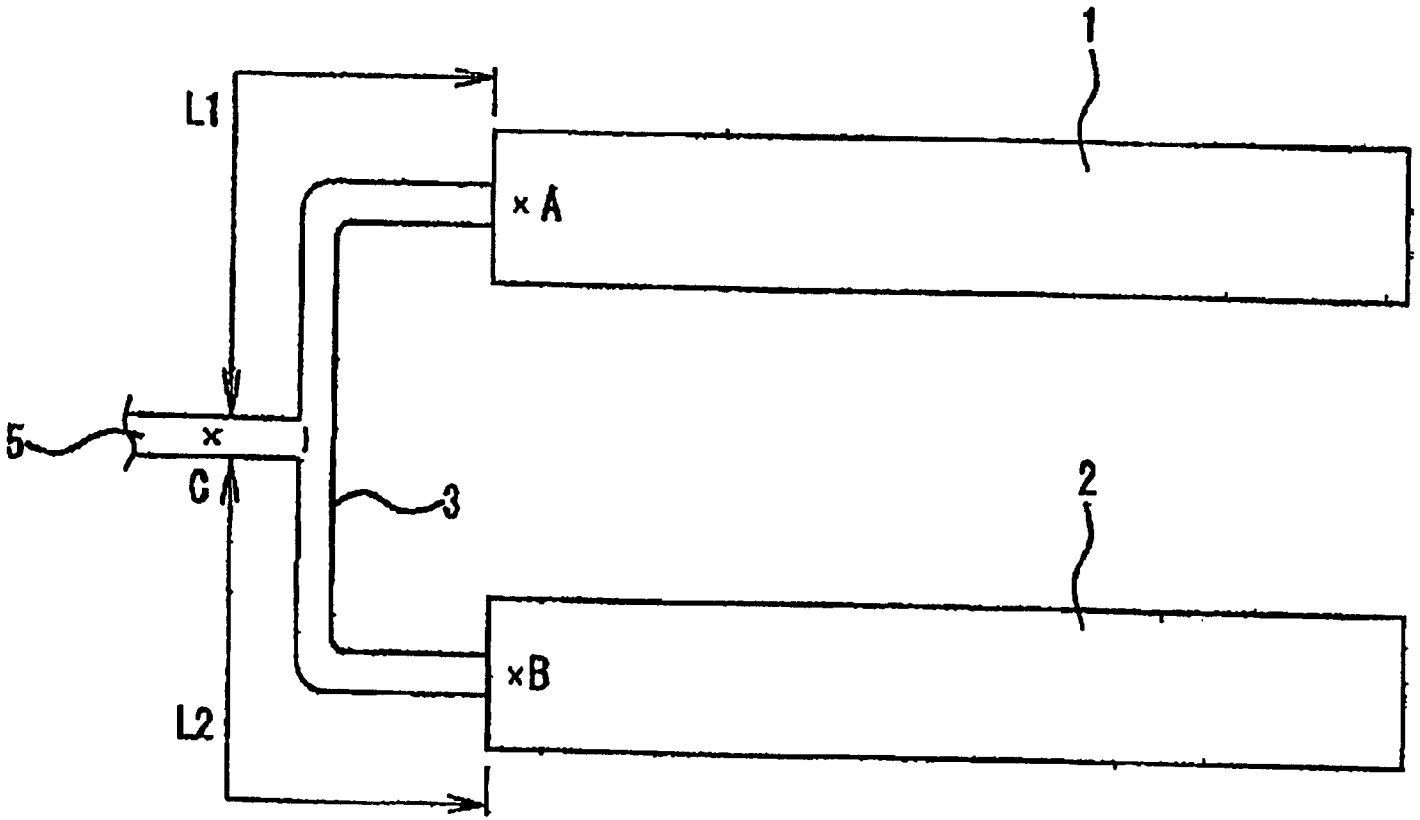
FIG. 2 is a plan view showing the positional relationship of a pair of fuel delivery pipes, connecting pipe and supply pipe in a first embodiment of the present invention.

FIGS. 1 and 2 will be used in explaining an embodiment of the present invention. A pair of fuel delivery pipes (1), (2) are disposed in parallel and are connected by a connecting pipe (3); a supply pipe (5) is connected to an intermediate section (L1=L2) of the length of the connecting pipe (3). L1 and L2 of this supply pipe (5) will be long in a horizontally opposed engine, and relatively short in a V-shaped engine. In addition, the connection of the supply pipe (5) to the connecting pipe (3) does not have to be the exact middle of the connecting pipe (3) but may be an intermediate section near the middle. The fuel delivery pipes (1), (2) are connected to the fuel tank (not shown in the drawings) via the supply pipe (5). The fuel delivery pipes (1), (2) are capable of absorbing and reducing pressure pulsation by means of elastic deformation of the outer walls thereof.

As shown in FIG. 1, these fuel delivery pipes (1), (2) that are capable of absorbing and reducing pressure pulsation by means of elastic deformation of the outer walls thereof are formed so as to have a compressed rectangular cross section, with a width of 34 mm, height of 10.2 mm, wall thickness of 1.2 mm and length of 300 mm; the radius of each of the four corners is 3.5 mm; and the material is steel piping conforming to Japanese Industrial Standard STKM11A. These fuel delivery pipes (1), (2) each communicate with three injection nozzles (6) disposed with a set interval therebetween, and thus constitute fuel delivery pipes for a six-cylinder engine. As stated above, because these fuel delivery pipes (1), (2) have a compressed cross sectional shape, pressure pulsation occurring within these fuel delivery pipes (1), (2) is absorbed by the inward and outward deformation of the wide upper and lower outer walls.

In a device configured as described above, measurement points A, B and C were placed at positions indicated by the mark X, as shown in FIG. 2, on the fuel delivery pipes (1), (2) connected to the connecting pipe (3) and on the supply pipe (5) connected to the connecting pipe (3); pressure pulsation arising from fuel injection by the injection nozzles (6) of the fuel delivery pipes (1), (2) was measured. The results of such measurement are shown in the graph of FIG. 6; the graph shows that pressure pulsations having opposite phases occurring at measurement point A of the fuel delivery pipe (1) and at measurement point B of the fuel delivery pipe (2) are absorbed and reduced by elastic deformation of the outer walls of the fuel delivery pipes (1), (2).

Figure 6:
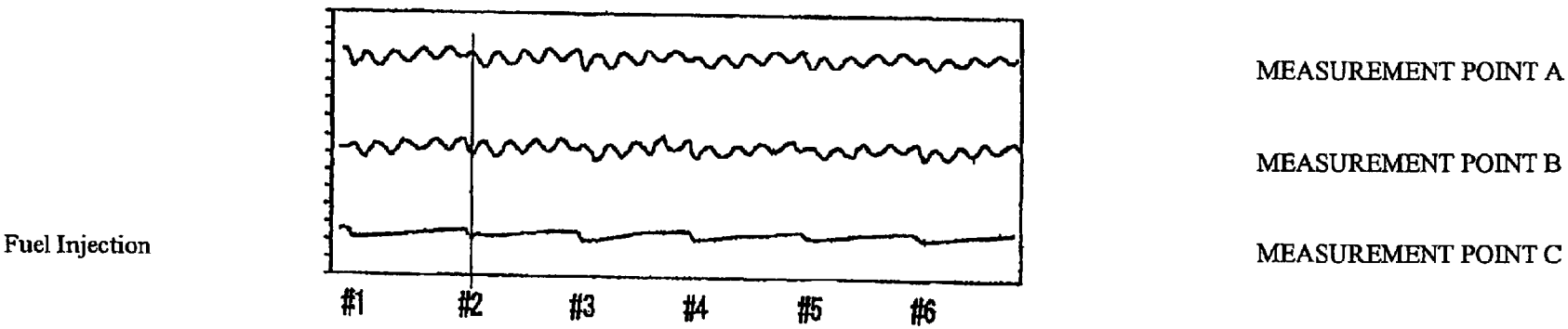
FIG. 6 is a graph showing pressure pulsation relationship between a pair of fuel delivery pipes and a supply pipe at 600 rpm in an embodiment of the present invention.

These pressure pulsations, having been absorbed and reduced, are propagated from the connecting pipe (3) to the supply pipe (5) connected to an intermediate section of the length of the connecting pipe (3); measurement of pressure pulsation at measurement point C provided in proximity to the intersection between the supply pipe (5) and the connecting pipe (3) indicates that, as shown in FIG. 6, pressure pulsations having opposite phases interfere with and attenuate each other. The indicia #1 through #6 in FIG. 6 show points of fuel injection by the injection nozzles (6) of the fuel delivery pipes (1), (2). As a result, pressure pulsation of the fuel delivery pipes (1), (2) propagated to the supply pipe (5), including piping below the floor, is significantly reduced.

Figure 7:
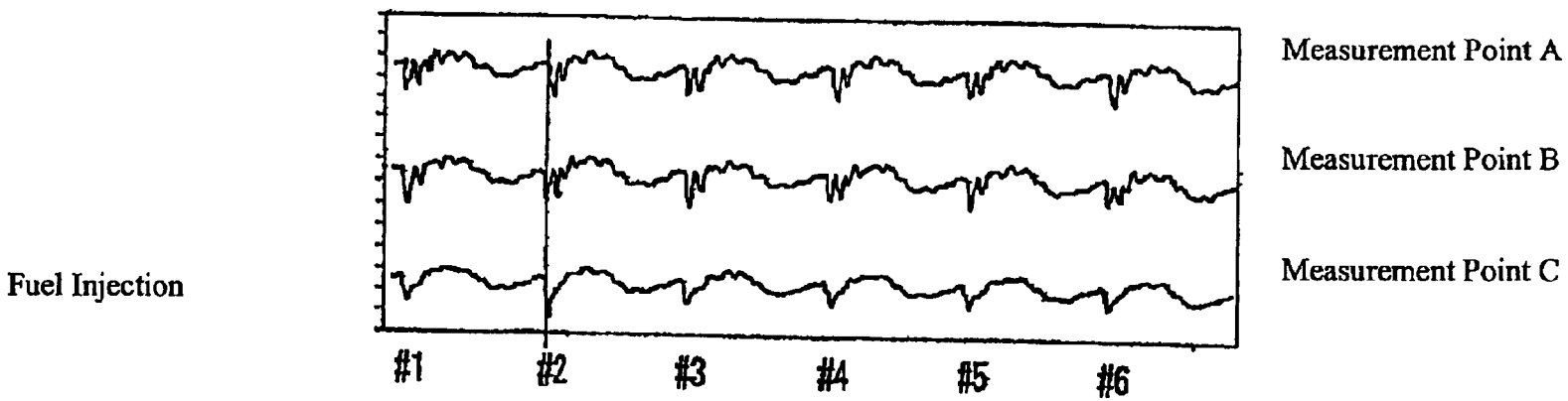
FIG. 7 is a graph showing pressure pulsation relationship between a pair of fuel delivery pipes and a supply pipe at 60 rpm in a comparative example.
Figure 8:
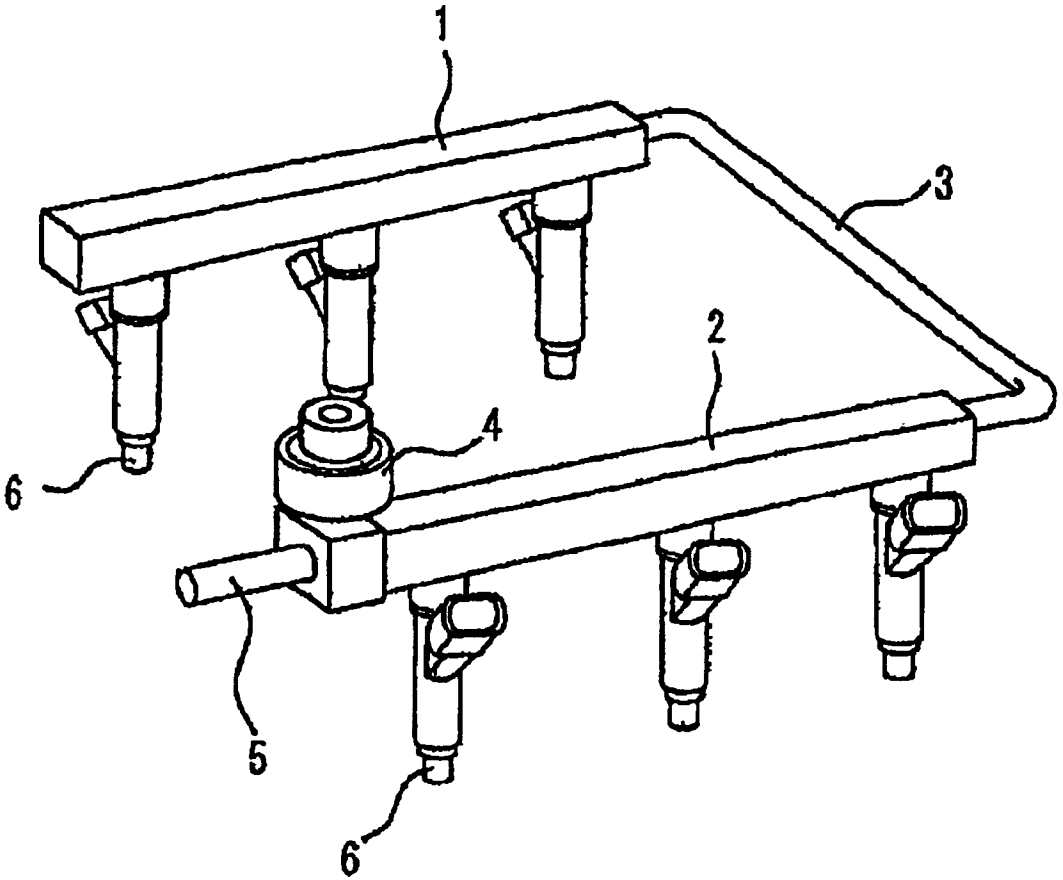
FIG. 8 is a perspective view showing a conventional example using a pulsation damper.
Figure 9:
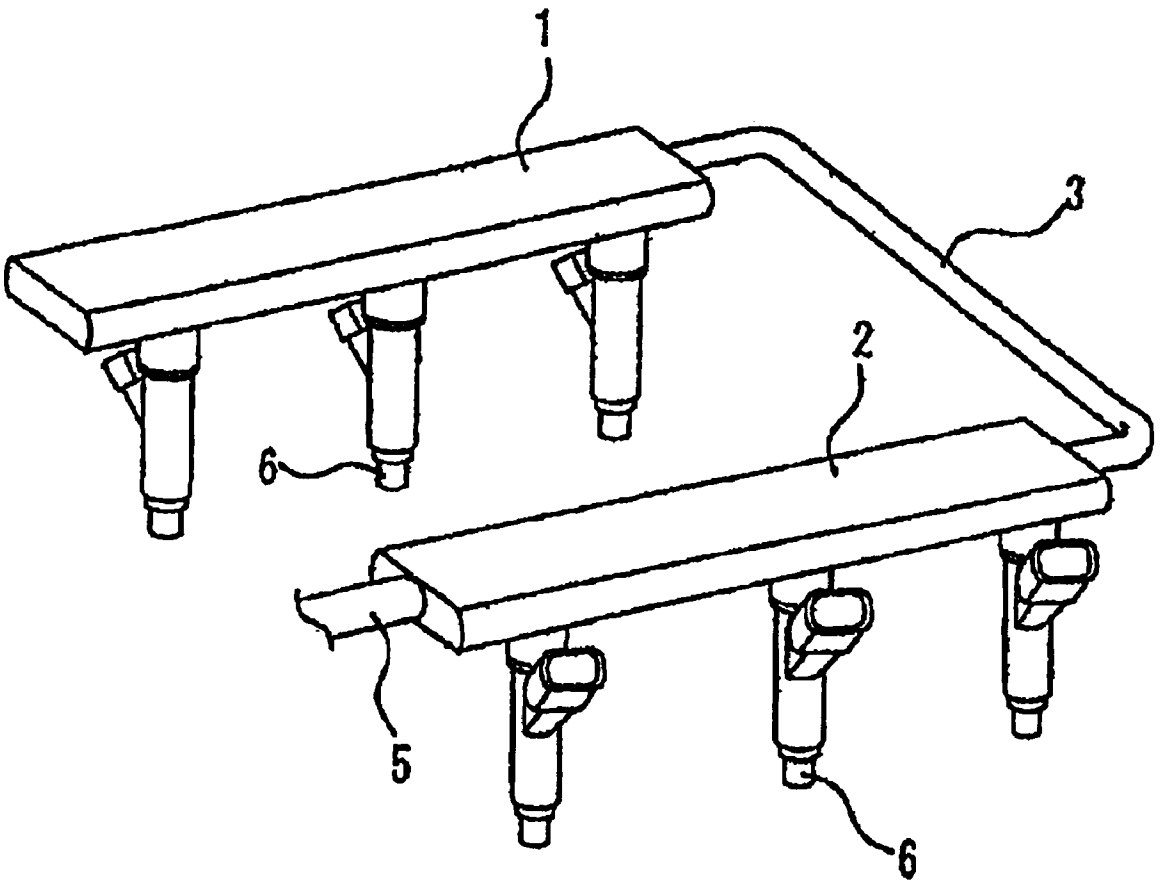
FIG. 9 is a perspective view of a conventional example using a fuel delivery pipe with pressure pulsation attenuation function.

Further, the fuel delivery pipes (1), (2) must be capable of absorbing and reducing pressure pulsation by means of elastic deformation of outer walls thereof; in cases where fuel delivery pipes (1), (2) having square or round piping, as in FIG. 8, are used, such piping not providing good pressure pulsation absorption and reduction effect, while there may be some substantial pressure pulsation absorption and reduction effect, such effect will not be sufficient. FIG. 7 is a graph showing a comparative example in a case where fuel delivery pipes (1), (2) not providing good pressure pulsation absorption and reduction were used.

For the fuel delivery pipes (1), (2) not providing good pressure pulsation absorption and reduction, measurement was carried out using fuel delivery pipes of square cross-section as in FIG. 8. These square fuel delivery pipes (1), (2) comprise square tubing having a width and height of 13 mm, wall thickness of 1.2 mm and length of 300 mm, and each communicates with three injection nozzles (6), for use in a six-cylinder engine. Steel piping was used for these square fuel delivery pipes (1), (2) conforming to Japanese Industrial Standard STKM11A.

In this comparative example, fuel delivery pipes not providing good pressure pulsation absorption and reduction were used in a configuration, as shown in FIG. 8, such that the supply pipe (5) is directly connected to one fuel delivery pipe (2). The results are as shown in FIG. 7; not only was the pressure pulsation in the fuel delivery pipes (1), (2) larger in comparison to the embodiment of the present invention, but there was no pressure pulsation absorption and reduction effect.

Figure 5:
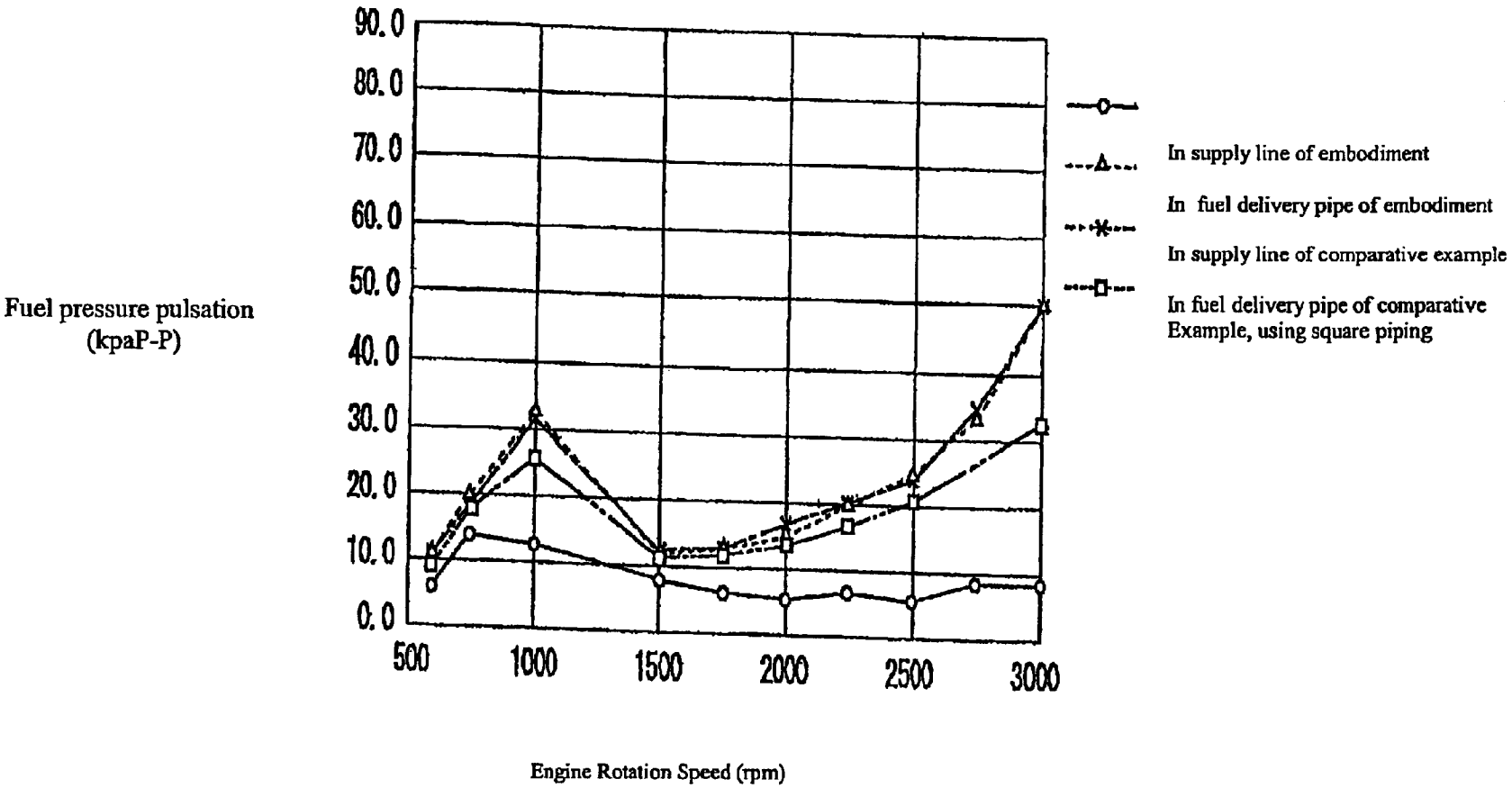
FIG. 5 is a graph showing pressure pulsation relationship between a pair of fuel delivery pipes and a supply pipe at 600–3,000 rpm.

Further, FIGS. 6 and 7 show measurements taken at 600 rpm. FIG. 5 shows measurement results taken in a range from 600 to 3000 rpm. In the embodiment of the present invention, it is clear that pressure pulsation with the fuel delivery pipes (1), (2) is greatly reduced at measurement point C. In the comparative example of FIG. 5, pressure pulsation in the supply pipe (5) is greater than the pressure pulsation in the fuel delivery pipes; this is because a configuration as shown in FIG. 8 was used, in which the supply pipe (5) is directly connected to one fuel delivery pipe (2).

Figure 3:
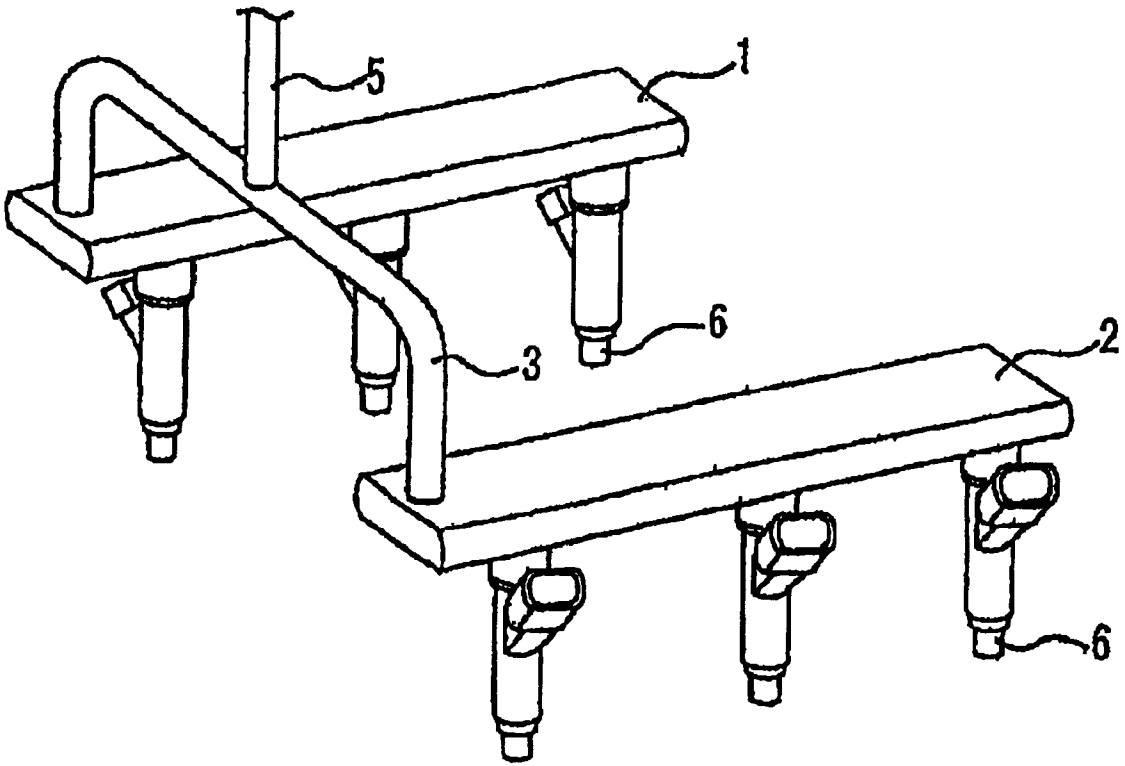
FIG. 3 is a perspective view showing the positional relationship of a pair of fuel delivery pipes, connecting pipe and supply pipe in another embodiment of the present invention.

In the above-described embodiment, as shown in FIGS. 1 and 2, the connecting pipe (3) is connected to the end face in the axial direction of the fuel delivery pipes (1), (2); however, the connection position of this connecting pipe (3) to the fuel delivery pipes (1), (2) can be determined as is appropriate in accordance with the layout of the engine chamber. In the embodiment shown in FIG. 3, the connecting pipe (3) is connected to the upper surface of the fuel delivery pipes (1), (2). In this case, the supply pipe (5) is connected to an intermediate section along the length of the connecting pipe (3).

Figure 4:
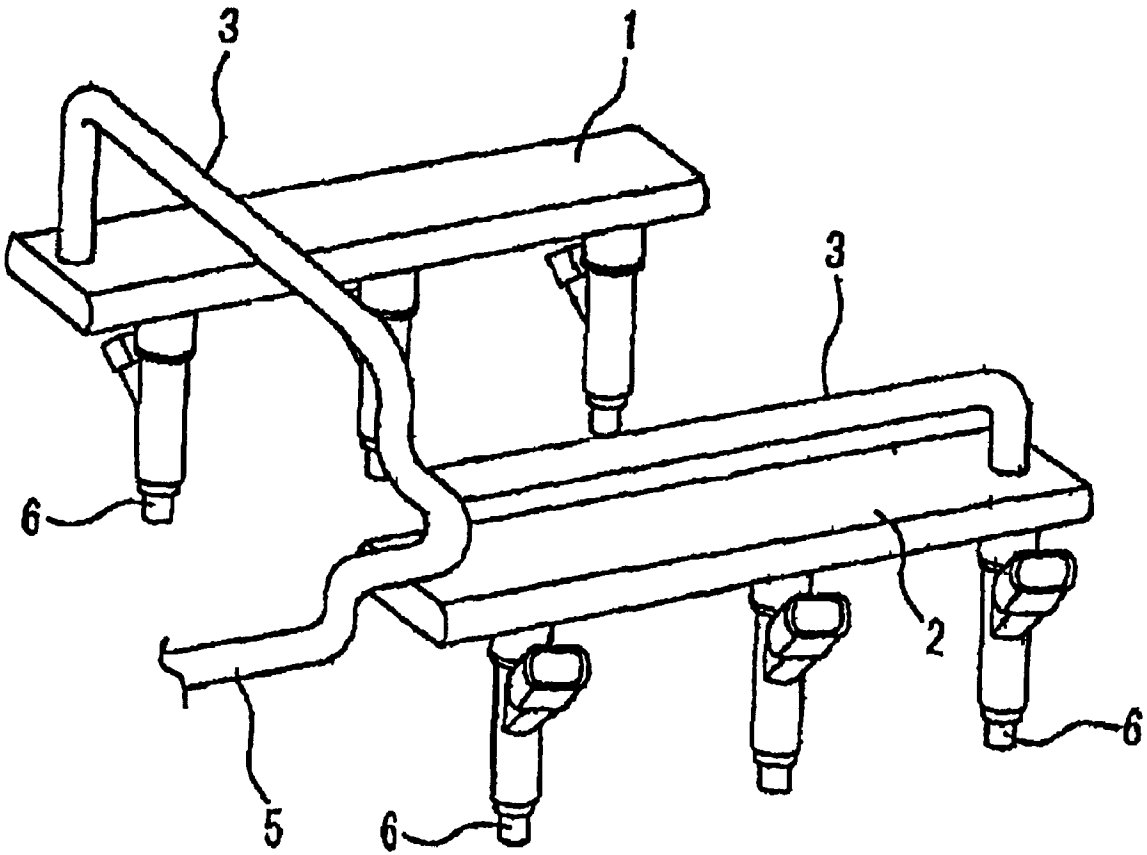
FIG. 4 is a perspective view showing the positional relationship of a pair of fuel delivery pipes, connecting pipe and supply pipe in yet another embodiment of the present invention.

In another embodiment of the present invention, as shown in FIG. 4, one end of the connecting pipe (3) is connected to one end of the upper surface of one fuel delivery pipe (1) which is capable of absorbing and reducing pressure pulsation through elastic deformation of outer walls thereof, and the other end of this connecting pipe (3) is connected to the other end of the upper surface of the other fuel delivery pipe (2). The supply pipe (5) is connected to an intermediate section of the length of the connecting pipe (3).

As described above, the present invention enables the absorption and attenuation of pressure pulsation arising from fuel injection in a returnless type fuel supply mechanism using a pair of fuel delivery pipes in a V-shaped, horizontally opposed, or other opposed engine; therefore, reduced engine output, harmful effects on the environment, noise caused by mechanical vibrations in the supply pipe and other ill effects arising from irregularity of fuel injection caused by pressure pulsation are prevented.

What is claimed is:

1. A method for attenuating pressure pulsation in an opposed type engine comprising, in a system in which for each of a pair of cylinder banks a returnless type fuel delivery pipe communicates with a plurality of injection nozzles and does not return fuel to the fuel tank and the cylinder banks each comprise a plurality of cylinders of an opposed engine having such banks disposed in a horizontally opposed or V-shaped manner, connecting a connecting pipe to the pair of fuel delivery pipes, and connecting the connecting pipe at an intermediate portion thereof to a supply pipe communicating with a fuel tank, the fuel delivery pipes being configured so as to be capable of absorbing and reducing pressure pulsation arising at time of fuel injection by the injection nozzles by means of elastic deformation of the outer walls thereof, whereby pressure pulsations with opposite phases arising from the fuel injection performed alternatingly between the cylinder banks by the injection nozzles are propagated to the connecting pipe and are caused to interfere with and attenuate each other in the supply pipe at or near intersection thereof with the intermediate portion of the connecting pipe.

2. Apparatus for attenuating pressure pulsation in an opposed type engine that is a returnless type comprising a plurality of injection nozzles but not comprising a loop for returning fuel to the fuel tank, the apparatus being capable of absorbing and reducing pressure pulsation arising at time of fuel injection by injection nozzles, comprising: fuel delivery pipes provided for each bank of an opposed engine, the banks comprising a plurality of cylinders and being disposed opposed horizontally or in a V-shape, a connecting pipe coupling the fuel delivery pipes, and a supply pipe that connects and communicates with an intermediate portion along the length of the connecting pipe and is connected with a fuel tank, whereby pressure pulsations with opposite phases arising from the fuel injection performed alternatingly between the cylinder banks by the injection nozzles of the fuel delivery pipes are propagated to the connecting pipe and are caused to interfere with and attenuate each other in the supply pipe at or near intersection thereof with the connecting pipe.

* * * * *